US008047102B2

(12) United States Patent
Gnatz

(10) Patent No.: US 8,047,102 B2
(45) Date of Patent: Nov. 1, 2011

(54) MULTI-PURPOSE TOOL

(75) Inventor: Chris Gnatz, Highwood, IL (US)

(73) Assignee: Chris Gnatz, Highwood, IL (US)

( * ) Notice: Subject to any disclaimer, the term of this patent is extended or adjusted under 35 U.S.C. 154(b) by 194 days.

(21) Appl. No.: 12/463,236

(22) Filed: May 8, 2009

(65) Prior Publication Data

US 2009/0282954 A1 Nov. 19, 2009

Related U.S. Application Data

(60) Provisional application No. 61/051,489, filed on May 8, 2008.

(51) Int. Cl.
*B25B 13/48* (2006.01)
*B25B 13/06* (2006.01)
*B25B 15/00* (2006.01)

(52) U.S. Cl. ..... 81/124.2; 81/124.7; 81/176.2; 7/165

(58) Field of Classification Search ..... 81/124.2, 81/124.3, 124.7, 176.2, 438, 439; 7/165
See application file for complete search history.

(56) References Cited

U.S. PATENT DOCUMENTS 3,086,414 A 4/1963 Nardi
3,151,512 A 10/1964 Charczenko
4,125,913 A * 11/1978 Lewis ..... 7/138
4,357,845 A 11/1982 Cornia
4,924,733 A * 5/1990 McKenzie ..... 81/438
5,048,378 A 9/1991 Nikolas
5,259,281 A 11/1993 Burke
5,287,775 A 2/1994 Moore
5,542,321 A 8/1996 Fuca
5,622,090 A 4/1997 Marks
D379,420 S 5/1997 Standlee et al.
5,697,268 A 12/1997 Makovsky et al.
5,791,209 A 8/1998 Marks
5,974,916 A 11/1999 Lassiter
6,220,129 B1 * 4/2001 Shimansky ..... 81/490
6,286,400 B1 * 9/2001 Anderson et al. ..... 81/439
6,305,255 B1 * 10/2001 Wu ..... 81/439
6,314,841 B1 11/2001 Burk et al.
(Continued)

*Primary Examiner* — David B Thomas
(74) *Attorney, Agent, or Firm* — McAndrews, Held & Malloy, Ltd.

(57) ABSTRACT

A multi-purpose tool may be comprised of a body having a gripping configuration on the outer surface of the body for long bolts and a lengthwise bore through the center of the body. The multi-purpose tool has a socket located at a first end of the body and a crown located at the second end of the body to receive various fasteners, such as flange and wing nuts. A multi-purpose tool may also be comprised of a body having a gripping configuration on the outer surface of the body and a lengthwise bore through the center of the body for a sleeve. The multi-purpose tool has a socket located in the sleeve at a first end of the sleeve and a crown located at the second end of the body to receive various fasteners, such as flange and wing nuts. The sleeve has a lengthwise bore through the center of the sleeve for long bolts or to accept a tool shaft. The tool shaft may accept various tool bits, and the tool shaft may be inserted into and engaged with the sleeve bore along its length. A cross hole extends in a substantially perpendicular direction through the center of the sleeve and the center of the body, respectively, which line up so the tool shaft may be inserted into and engaged with the sleeve bore for use as a T-handle.

9 Claims, 6 Drawing Sheets

U.S. PATENT DOCUMENTS

| | | | | |
|---|---|---|---|---|
| 6,374,708 | B1 | 4/2002 | Kunz | |
| 6,494,121 | B1 * | 12/2002 | Hu | 81/439 |
| 6,626,071 | B2 * | 9/2003 | Kesinger et al. | 81/437 |
| 6,715,384 | B1 | 4/2004 | Kozak | |
| 6,928,906 | B1 | 8/2005 | Marks | |
| 6,978,504 | B1 * | 12/2005 | Smith et al. | 7/165 |
| 7,069,820 | B2 | 7/2006 | Goacher, Sr. | |
| 7,117,766 | B1 | 10/2006 | Boehringer | |
| 7,127,970 | B2 | 10/2006 | Kirchgaessler | |
| 7,231,852 | B1 | 6/2007 | Henin et al. | |
| 7,290,469 | B2 | 11/2007 | Walters et al. | |
| 7,293,482 | B1 | 11/2007 | Wolf et al. | |
| 7,413,693 | B2 | 8/2008 | Goacher, Sr. | |
| D578,363 | S | 10/2008 | Cacciacarne | |
| 7,430,944 | B1 | 10/2008 | Miller | |
| 2006/0130621 | A1 * | 6/2006 | Novak et al. | 81/439 |
| 2007/0163400 | A1 * | 7/2007 | Parise | 81/176.1 |

* cited by examiner

MULTI-PURPOSE TOOL

RELATED APPLICATIONS

This application makes reference to, claims priority to, and claims the benefit of U.S. Provisional Patent Application Ser. No. 61/051,489, entitled "Nice N' Tite Multi tool," filed May 8, 2008, the complete subject matter of which is hereby incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present multi-purpose tool generally relates to the field of hand tools used with mechanical fasteners. More specifically, the present multi-purpose tool relates to hand tools designed to engage multiple fittings and fasteners, such as hexagonal bolts and nuts, screws, and wing nuts. The present multi-purpose tool may be included in an installation kit accompanying an article employing multiple fittings and fasteners.

A variety of tools are often needed to deal with the multitude of fasteners encountered on a given job. This is often the case for plumbers or do-it-yourselfers doing plumbing work. In some cases, many different fittings and fasteners may be present on a single plumbing fixture. For example, installing a toilet frequently involves the use of hexagonal bolts and/or nuts, screws, flange nuts, and/or wing nuts. The wing nuts or flange nuts are often threaded over long bolts. Toilets are not sold with tools capable of securing these fasteners. Toilet installers are therefore forced to obtain tools separately, which may be inconvenient and expensive. Hand tightening some of these fasteners in the cramped conditions typically associated with toilet installation can result in hand cramps and even injury, which is particularly problematic in the often unsanitary environment posed by the installation or removal of an existing toilet. The use of multiple tools for toilet installation can be time consuming as one searches for the proper tool, and switches between tools during the installation. In addition, carrying around a variety of tools to the job site may be cumbersome.

Another job involving a multitude of fasteners is shutter installation or removal. Many different fittings and fasteners may be present on a single storm shutter. For example, installing or removing storm shutters frequently involves the use of hexagonal bolts and/or nuts, screws, and/or wing nuts. Shutters are not sold with tools capable of securing these fasteners. Shutter operators are therefore forced to obtain tools separately, which may be inconvenient and expensive. The use of multiple tools for shutter installation can be time consuming as one searches for the proper tool, and switches between tools during the installation. This is particularly problematic when hurriedly attempting to secure storm shutters, for instance, in the face of an approaching hurricane. As with toilet installation, carrying around a variety of tools to the job site may be cumbersome, and even more so with multiple shutters.

BRIEF SUMMARY OF THE INVENTION

One embodiment of the present multi-purpose tool comprises a body, the body having an outer surface, a first end, and a second end, a socket located at the first end of the body, a crown located at the second end of the body, the crown having at least one pair of opposing receivers, and a bore extending through the center of the body lengthwise.

Other embodiments of the multi-purpose tool may further comprise body grips on the outer surface of the body, which may be groove in the outer surface of the body. The cross section of the body may vary, and may include a cross section that is substantially circular or substantially hexagonal. Socket configurations can also vary, and may include a four-sided or hexagonal socket.

In addition, the receivers in the crown may have an outer receiver portion and an inner receiver portion, with the outer receiver portion being larger than the inner receiver portion. The portions may be connected by a transition radius. Body materials may comprise aluminum, plastic, or other suitable materials. Further, the multi-purpose tool may be included in a kit comprising a toilet, toilet installation hardware, and the multi-purpose tool, or a kit comprising storm shutters, installation hardware for the storm shutters, and the multi-purpose tool.

Yet another embodiment of the multi-purpose tool comprises a body, the body having an outer surface, a first end, and a second end, a crown located at the second end of the body, the crown having at least one pair of opposing receivers, a body bore extending through the center of the body lengthwise, a body cross hole near the center of the body extending through the body substantially perpendicular to the body bore, a sleeve located within the bore, the sleeve having a first end and a second end, a socket located at the first end of the sleeve, a sleeve bore extending through the center of the sleeve lengthwise, a sleeve cross hole near the center of the sleeve extending through the sleeve substantially perpendicular to the sleeve bore, a tool shaft for accepting tool bits, and wherein the tool shaft may be inserted into and engaged with the sleeve bore or inserted through and engaged with the sleeve at the sleeve cross hole.

The tool shaft may further comprise mating protrusions and a spring loaded ball, and the sleeve may further comprise grooves in the sleeve bore and a locking hole through the sleeve substantially perpendicular to the sleeve bore. The tool shaft may then be engaged with the sleeve bore by mating the grooves in the sleeve bore with the mating protrusions on the tool shaft, and the tool shaft may be held in the sleeve bore by mating the spring loaded ball with the locking hole.

Still further other embodiments of the multi-purpose tool may comprise body grips on the outer surface of the body, which may be groove in the outer surface of the body. The cross section of the body may vary, and may include a cross section that is substantially circular or substantially hexagonal. Socket configurations can also vary, and may include a four-sided or hexagonal socket.

In addition, the receivers in the crown may have an outer receiver portion and an inner receiver portion, with the outer receiver portion being larger than the inner receiver portion. The portions may be connected by a transition radius. Body materials may comprise aluminum, plastic, or other suitable materials.

Additional objects and advantages of the invention are set forth in, or will be apparent to those of ordinary skill in the art from the detailed description herein. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features or the like.

BRIEF DESCRIPTION OF SEVERAL VIEWS OF THE DRAWINGS

A full and enabling disclosure of the present invention, including the best mode thereof, directed to one of ordinary skill in the art, is set forth in the specification, which makes reference to the appended figures, in which.

Figure 3:
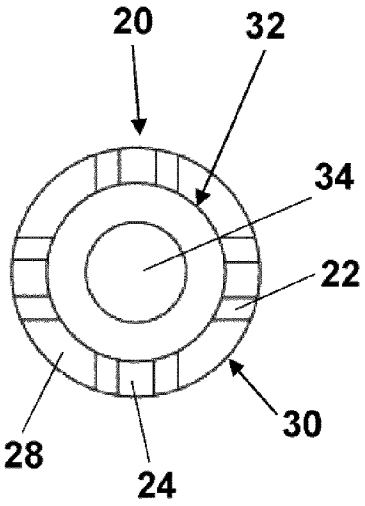
FIG. 3 is a second end view of the present multi-purpose tool of FIG. 1.

Repeat use of reference characters throughout the present specification and appended drawings is intended to represent same or analogous features or elements of the invention.

DETAILED DESCRIPTION OF THE INVENTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on or with another embodiment to yield a still further embodiment. Thus, it is intended that the present invention cover such modifications and variations. Other objects, features and aspects of the present invention are disclosed in or are apparent from the following detailed description. It is to be understood by one of ordinary skill in the art that the present discussion is a description of exemplary embodiments only, and is not intended as limiting the broader aspects of the present invention.

Figure 1:
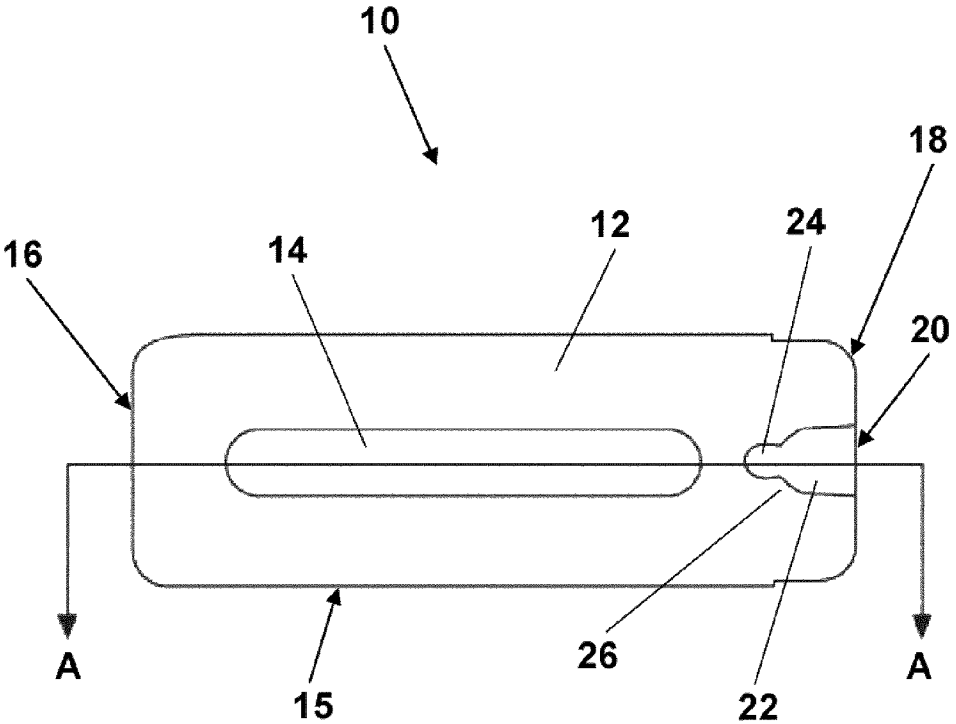
FIG. 1 is a side view of an embodiment of the present multi-purpose tool.
Figure 2:
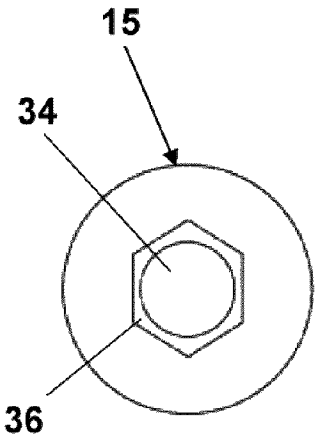
FIG. 2 is a first end view of the of the present multi-purpose tool of FIG. 1.

FIGS. 1 through 4 depict an embodiment of the present multi-purpose tool. Referring to FIG. 1, multi-purpose tool 10 includes a body 12 having an outer surface 15. Body 12 may be constructed from a variety of rigid materials, including for example metals, such as pot metal, aluminum, stainless steel or titanium, and injected, extruded or molded plastics, including Delrin. Body grips 14 may be provided in outer surface 15. Body grips 14 may be spaced around body 12 to provide enhanced grip for the user of multi-purpose tool 10. Body grips 14 are depicted as depressions or grooves, but could also be raised sections of body 12. Further, as best seen in FIG. 2, the cross section of outer surface 15 may be circular. However, other cross sections of outer surface 15 are contemplated. For example, the cross section of outer surface 15 may be hexagonal in shape (not shown).

Body 12 has a first end 16 and a second end 18. As best seen in FIG. 2, a socket 36 is located at first end 16. Socket 36 is shown configured to engage hexagonal fasteners, but other configurations of socket 36 are contemplated. For example, socket 36 may be configured in a four-sided arrangement. In other words, socket 36 may be configured in a variety of ways to engage flange nuts, square nuts, etc. For toilet tool applications, it is preferred that socket 36 be configured to engage the fasteners that secure the wax ring flange to the floor.

At the second end 20 of body 12, crown 28 incorporates receivers 20 for accepting and engaging fasteners, e.g. flange or wing nuts. While two receivers 20 located on opposite sides of crown 28 may be used, it is preferred that crown 28 incorporate four receivers spaced 90 degrees apart around crown 28 as seen in FIG. 3 because four receivers 20 may promote a quicker engagement of flange and wing nuts than two receivers.

Receivers 20 may include an outer receiver portion 22 and an inner receiver portion 24. Outer receiver portion 22 is sized larger than inner receiver portion 24 such that receiver 20 can accommodate numerous different sizes of flange and wing nuts. Receiver may incorporate a transition radius 26 (best seen in FIG. 1) to promote quicker engagement of nuts by inner receiver portion 24.

Figure 4:
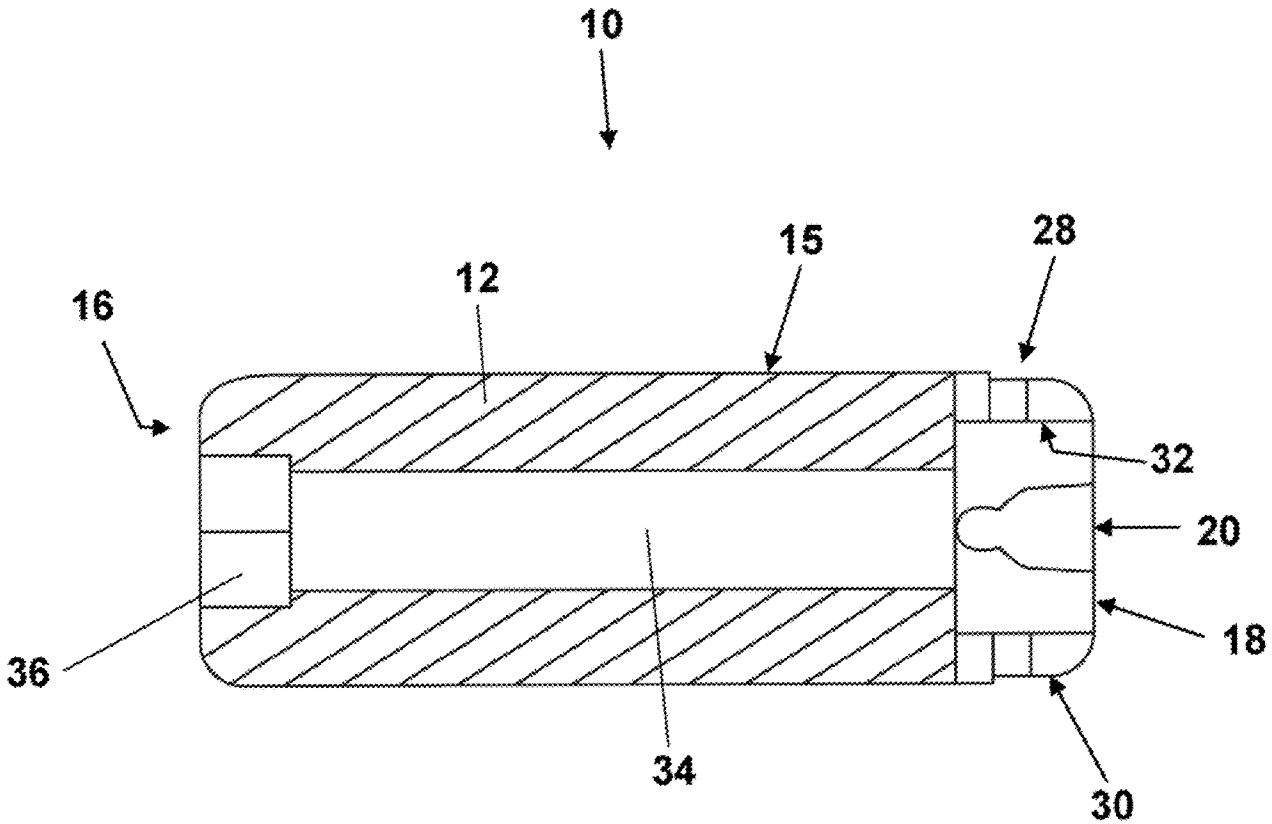
FIG. 4 is a section view of the present multi-purpose tool of FIG. 1 along section line AA.

Turning to FIG. 4, a bore 34 runs lengthwise through the center axis of body 12. Bore 34 permits long bolts to extend into body 12 while multi-purpose tool 10 engages associated fasteners.

Multi-purpose tool 10 has many applications. For example, multi-purpose tool 10 may be used by do-it-yourselfers or professionals in automotive, construction, and around the home applications. In one application, multi-purpose tool 10 may be included in an installation kit with a new toilet, since toilets typically come with a variety of fasteners, such as flange or wing nuts, hexagonal bolts or nuts, etc. Thus, a multi-purpose tool 10 may be included in a kit (not shown) comprising a toilet, toilet installation hardware, such as nuts, bolts, gaskets, seals, etc., and multi-purpose tool 10. It is preferable to use a plastic body 12 for such an application to lower weight and cost. Multi-purpose tool 10 may even be disposable in this application.

Another application involves storm shutters. For example, multi-purpose tool 10 may be included in an installation kit with new shutters. More specifically, multi-purpose tool 10 may be included in a kit (not shown) comprising shutters, shutter hardware, such as nuts, bolts, screws, etc., and multi-purpose tool 10. Further, it would be advantageous to connect multi purpose tool 10 to existing or new shutters using, for example, a clip or chain, so multi-purpose tool 10 would be available immediately in the event of an approaching storm. It is preferable to use a material for the body 12 that will handle outdoor conditions well for such an application, such as non-ferrous materials like plastic or aluminum.

Figure 5:
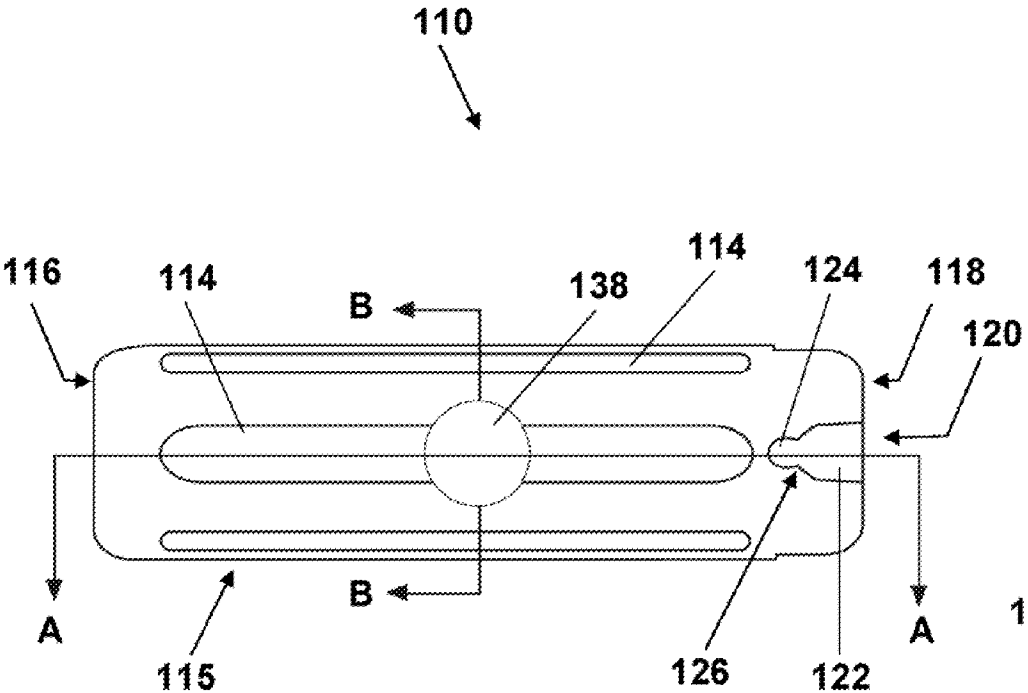
FIG. 5 is a side view of an embodiment of the present multi-purpose tool.
Figure 6:
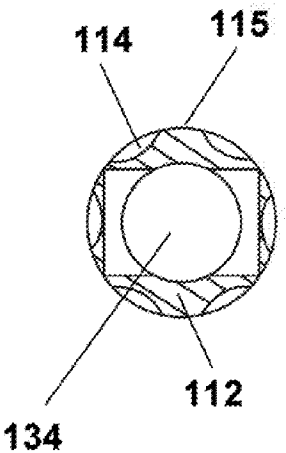
FIG. 6 is a first end view of the of the present multi-purpose tool of FIG. 5.
Figure 8:
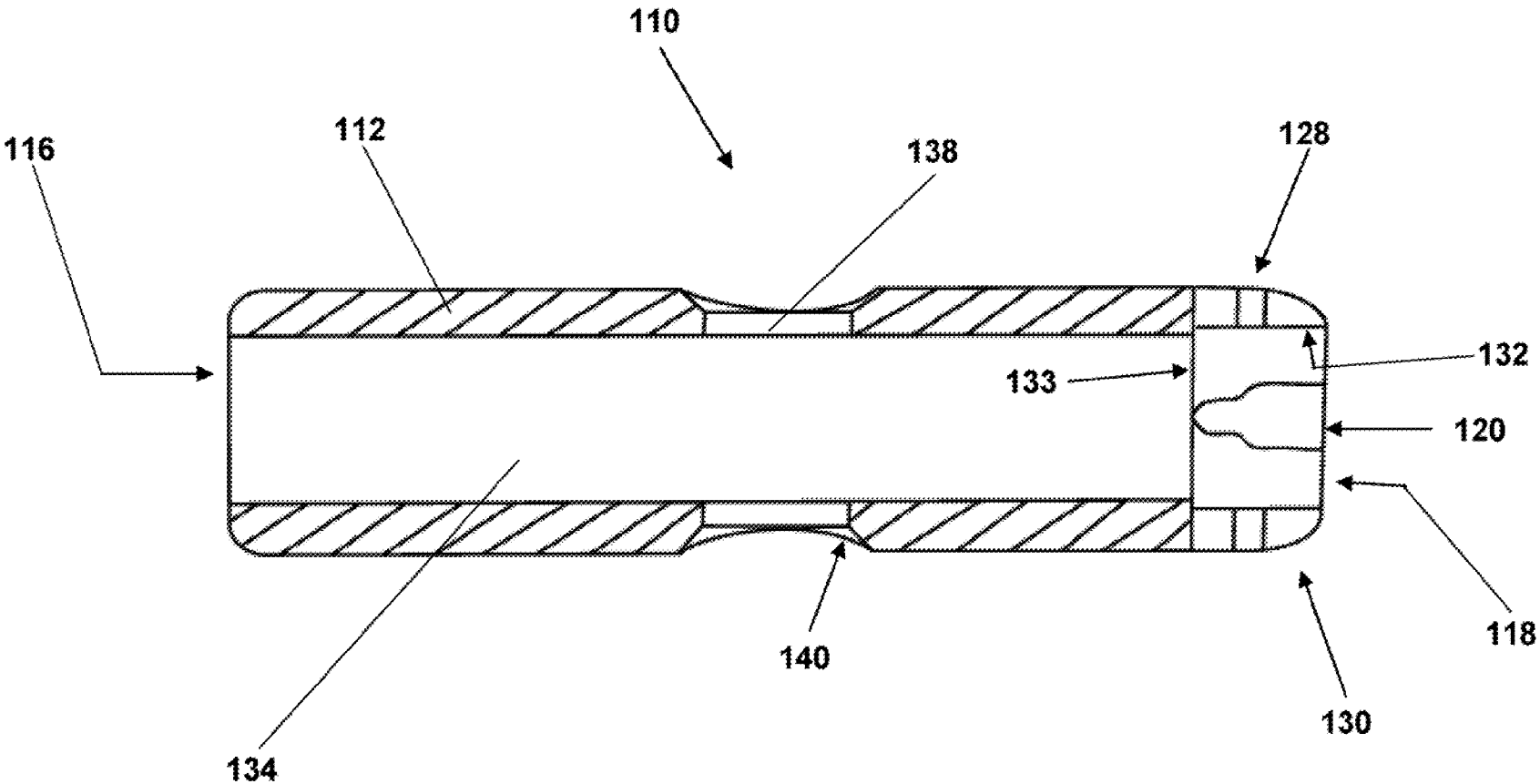
FIG. 8 is a section view of the present multi-purpose tool of FIG. 5 along section line BB.

FIGS. 5 through 12 depict another embodiment of the present multi-purpose tool. Referring to FIG. 5, multi-purpose tool 110 includes a body 112 having an outer surface 115. Body 112 may be constructed from a variety of rigid materials, including for example metal, such as aluminum, and plastic. Body grips 14 may be provided in outer surface 15. Body grips 114 may be spaced around body 112 to provide enhanced grip for the user of multi-purpose tool 110. Body grips 114 are depicted as depressions or grooves, but could also be raised sections of body 112. Further, as best seen in FIG. 6, the cross section of outer surface 115 may be circular. However, other configurations of outer surface 115 are envisioned. For example, the cross section of outer surface 115 may be hexagonal in shape (not shown).

Figure 7:
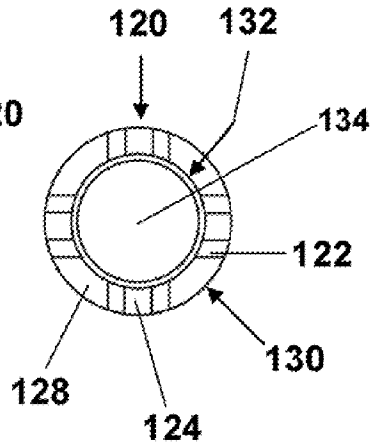
FIG. 7 is a second end view of the of the present multi-purpose tool of FIG. 5.

Body 112 has a first end 116 and a second end 118. As best seen in FIG. 7, the second end 118 of body 112 includes a crown 28, which incorporates receivers 120 for accepting and engaging fasteners, e.g. flange or wing nuts. While two receivers 120 located on opposite sides of crown 128 may be used, it is preferred that crown 128 incorporate four receivers spaced 90 degrees apart around crown 128 as seen in FIG. 7 as four receivers 120 promote a quicker engagement of flange and wing nuts than two receivers.

Bore 134 runs lengthwise through the center of body 112. Bore 134 is designed to accept sleeve 142 (see FIGS. 9 through 11). Bore 134 may include a mating structure, such as spline or groove, to prevent spinning of sleeve 142 within body 112 by mating with a corresponding structure in outer surface 145 of sleeve 142 (not shown). Sleeve 142 is preferably made from stainless steel. Sleeve 142 is positioned in body 112 between first end 116 and base 133 of crown 128.

Figure 10:
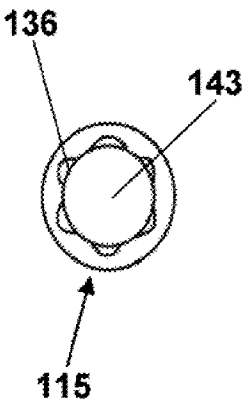
FIG. 10 is a first end view of the of the inner sleeve of FIG. 9.

Turning to FIG. 10, a socket 136 is located at first end 144 of sleeve 142. Socket 136 is shown configured to engage hexagonal fasteners, but other configurations of socket 136 are contemplated. For example, socket 136 may be configured to engage flange nuts, square nuts, etc. (not shown). For toilet tool applications, it is preferred that socket 136 be configured to engage the fasteners that secure the wax ring flange to the floor.

Figure 11:
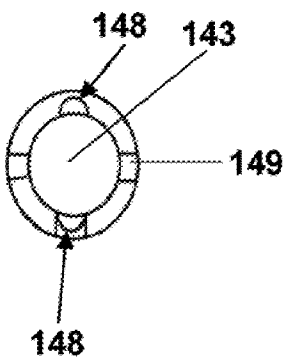
FIG. 11 is a second end view of the inner sleeve of FIG. 9.
Figure 9:
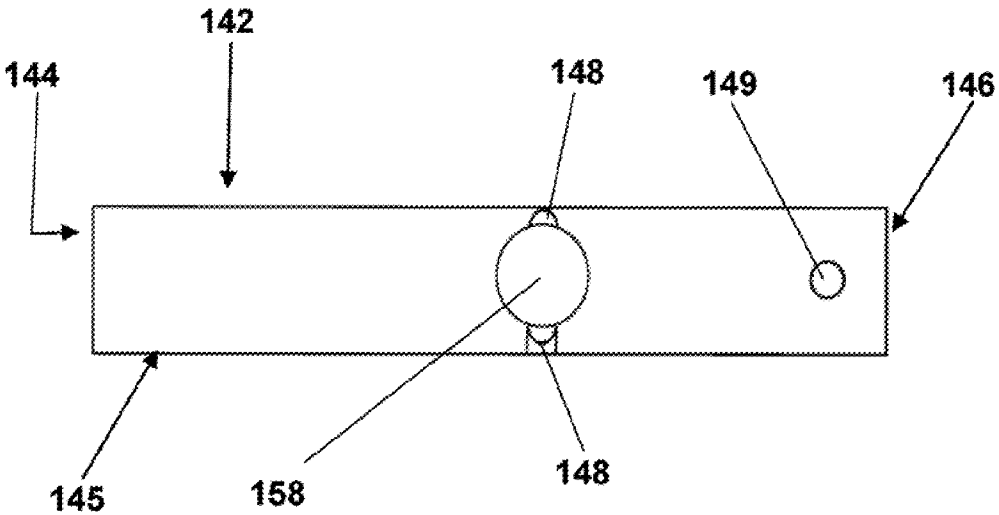
FIG. 9 is a side view of an inner sleeve for use with the present multi-purpose tool of FIG. 5.
Figure 12:
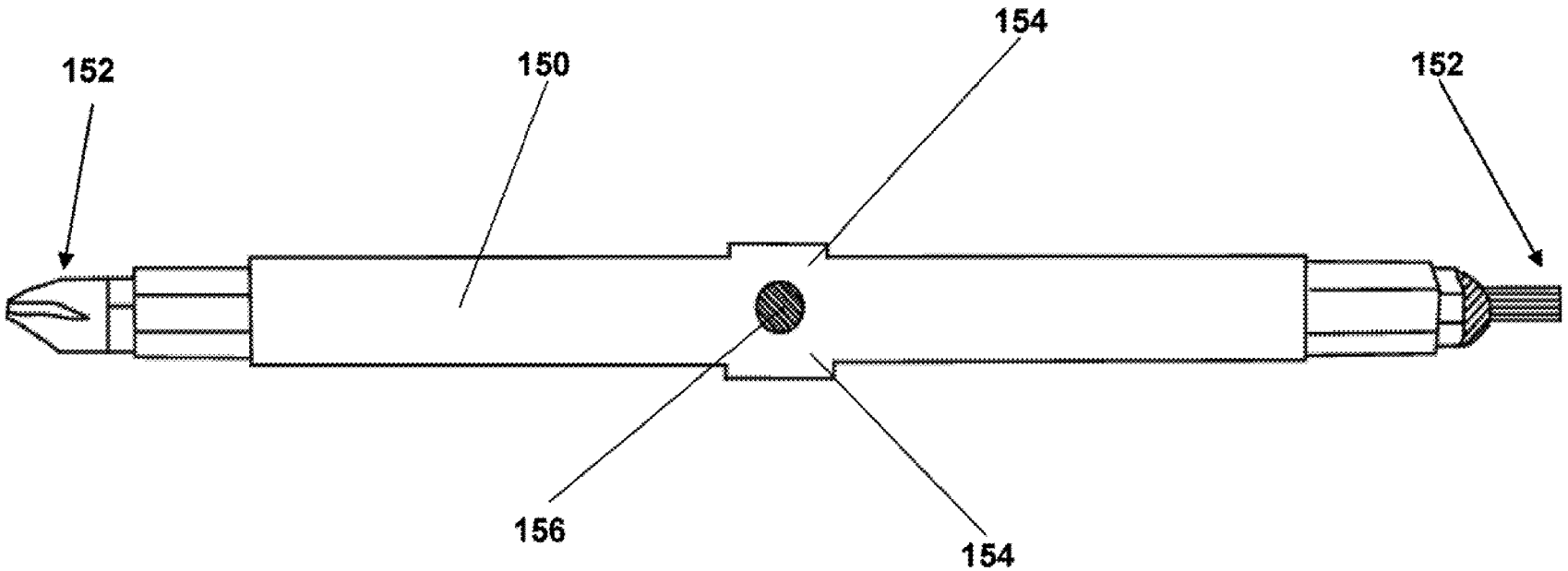
FIG. 12 is a perspective view of a tool shaft and tool bits.

Sleeve 142 has a bore 143 that is configured to accept a tool shaft 150 (see FIG. 12), which in turn accepts standard ¼-inch hex shank tool bits 152. One commercially available tool shaft 150 for multi-purpose tool 110 is the shaft on the 10-in-1 screwdriver by Klein. As best seen in FIGS. 9 and 11, the tool shaft 150 is engaged and held in sleeve 142 by mating protrusions 154 on tool shaft 150 with grooves 148 in second end 146 of sleeve 142, and mating spring ball 156 on tool shaft 150 with locking hole 149 in second end 146 of sleeve 142. When engaged and held in sleeve 142, tool shaft 150 is positioned inward of socket 136 at first end 144 and extends beyond second end 146 to expose a tool bit 152. The second end 146 of sleeve 142 Tool bits 152 are depicted in FIG. 12 as a Phillips head screwdriver bit and a Torx bit, yet a large variety of other commercially available tool bits can be utilized in tool shaft 150.

A body cross hole 138 is located near the center of body 112 and extends through body 112 substantially perpendicular to bore 134. Body cross hole 138 lines up with sleeve cross hole 158 (see FIG. 9) such that tool shaft 150 can be inserted through cross hole 138 to form a T-handle that can be used to apply extra torque when loosening or tightening fasteners. The tool shaft 150 is engaged and held in sleeve 142 by mating protrusions 154 on tool shaft 150 with grooves 148 at cross hole 138 of sleeve 142.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged either in whole or in part. Therefore, the spirit and scope of the appended claims should not be limited to the description of the preferred versions contained therein.

What is claimed is:

1. A multi-purpose tool comprising:

a body, the body having an outer surface, body grips on the outer surface, a first end, and a second end;

a crown located at the second end of the body, the crown having at least one pair of opposing receivers;

a body bore extending through the center of the body lengthwise;

a body cross hole near the center of the body extending through the body substantially perpendicular to the body bore;

a sleeve located within the bore, the sleeve having a first end and a second end;

a socket located at the first end of the sleeve;

a sleeve bore extending through the center of the sleeve lengthwise;

a sleeve cross hole near the center of the sleeve extending through the sleeve substantially perpendicular to the sleeve bore;

a tool shaft for accepting tool bits;

wherein the tool shaft may be inserted into and engaged with the sleeve bore or inserted through and engaged with the sleeve at the sleeve cross hole.

2. The multi-purpose tool of claim 1, wherein the body grips are grooves in the outer surface of the body.

3. The multi-purpose tool of claim 1, wherein the tool shaft further comprises mating protrusions and a spring loaded ball, and the sleeve further comprises grooves in the sleeve bore near the sleeve cross hole and the second end of the sleeve, and a locking hole through the sleeve substantially perpendicular to the sleeve bore.

4. The multi-purpose tool of claim 3, wherein the tool shaft is engaged with the sleeve bore by mating the grooves in the sleeve bore near the second end of the sleeve with the mating protrusions on the tool shaft, and the tool shaft is held in the sleeve bore by mating the spring loaded ball with the locking hole.

5. The multi-purpose tool of claim 3, wherein the tool shaft is engaged with the sleeve bore by mating the grooves in the sleeve bore near the sleeve cross hole with the mating protrusions on the tool shaft.

6. The multi-purpose tool of claim 1, wherein the receivers have an outer receiver portion and an inner receiver portion connected by a transition radius, and wherein the outer receiver portion is larger than the inner receiver portion.

7. The multi-purpose tool of claim 1, wherein the body is comprised of aluminum.

8. The multi-purpose tool of claim 1, wherein the body is comprised of plastic.

9. The multi-purpose tool of claim 1, wherein the socket is hexagonal.

* * * * *